US005383315A

United States Patent [19]

Birs

[11] Patent Number: 5,383,315

[45] Date of Patent: Jan. 24, 1995

[54] HURRICANE SHUTTER REINFORCEMENT AND METHOD

[76] Inventor: Richard Birs, 7623 NW. 74 Terrace, Tamarac, Fla. 33321

[21] Appl. No.: 127,232

[22] Filed: Sep. 27, 1993

[51] Int. Cl.[6] ..... E06B 3/32

[52] U.S. Cl. ..... 52/202; 52/203; 52/509; 49/49; 49/50; 49/61

[58] Field of Search ..... 52/202, 203, 509, 512; 49/49, 50, 60, 61, 62

[56] References Cited

U.S. PATENT DOCUMENTS

| | | | |
|---|---|---|---|
| 1,052,670 | 2/1913 | Francis | 52/509 |
| 1,633,848 | 6/1927 | Dandridge | 49/61 |
| 2,549,661 | 4/1951 | Carney | 49/50 |
| 2,777,174 | 1/1957 | Carr | 49/61 |
| 2,876,871 | 3/1959 | Coffman et al. | 52/512 |
| 3,942,764 | 3/1976 | Beversdorf | 49/50 |
| 4,287,683 | 9/1981 | Louwenaar | 52/202 |
| 4,333,271 | 6/1982 | De Paolo et al. | 52/202 |
| 4,384,436 | 5/1983 | Green | 52/202 |
| 4,467,574 | 8/1984 | Falge et al. | 49/50 |
| 4,505,079 | 3/1985 | Black | 52/202 |

*Primary Examiner*—Carl D. Friedman
*Assistant Examiner*—Wynn E. Wood
*Attorney, Agent, or Firm*—Herbert L. Lerner; Laurence A. Greenberg

[57] ABSTRACT

An improved hurricane shutter is disclosed. The shutter is of the type in which a plurality of interlocking corrugated panels are attached between a header above the opening and a sill below the opening. The corrugated panels extend beyond lateral edges of the opening, so that they cover the entire opening. The hurricane shutter is improved with a reinforcement bar extending substantially parallel to and midway in between the header and the sill of the opening. The bar is additionally attached to the wall structure next to the opening. A concomitant method for improving the strength of a hurricane shutter assembly is also disclosed.

13 Claims, 2 Drawing Sheets

HURRICANE SHUTTER REINFORCEMENT AND METHOD

BACKGROUND OF THE INVENTION

1. Field of the Invention

The invention relates to hurricane shutters and storm shutters and, more particularly, to an improvement in their resistive strength.

2. Description of the Related Art

Hurricane shutters with interlocking, corrugated panels are known from U.S. Pat. No. 4,333,271 to DePaolo et al., for instance. A number of panels are placed side-by-side. The edge corrugations of adjacent panels overlap one another, so that a lateral form-lock is created among the individual panels. The panels are attached just above and just below the opening to be covered, which is usually a window or a door. In a preferred embodiment, the panels are guided in a U-rail above the opening and they are individually bolted to the wall or a rail below the opening. In some embodiments, a U-rail is also employed as the lower attachment.

While the corrugated shutters of that kind are quite effective under "normal" conditions—such as hurricane force winds of no more than about 120 mph—they cannot withstand hurricane force winds in the upper categories. Wind strength during the recent hurricanes Hugo (category 3–4) and Andrew (category 4–5) reached speeds of more than 160 mph, and over 200 mph by some accounts. In the areas of South Miami hardest hit by hurricane Andrew, for instance, some houses were severely damaged even though corrugated panels were installed and they were built in CBS structure.

SUMMARY OF THE INVENTION

It is accordingly an object of the invention to provide a hurricane shutter reinforcement and method, which overcomes the hereinafore-mentioned disadvantages of the heretofore-known devices of this general type and which will enable the corrugated, interlocking panels to withstand winds in the upper hurricane categories.

With the foregoing and other objects in view there is provided, in accordance with the invention, an improved hurricane shutter assembly for protecting an opening of a building, of the type in which a plurality of corrugated panels are attached between a header above the opening and a sill below the opening, and in which the corrugated panels extend beyond lateral edges of the opening for covering substantially the entire opening, wherein the improvement comprises:

a reinforcement bar extending in between the header and the sill of the opening to be covered, and means for attaching the reinforcement bar to a wall structure disposed laterally of the opening.

Preferably, the reinforcement bar is a center bar which extends substantially parallel to and midway in between the sill and the header.

In accordance with an added feature of the invention, the reinforcement bar is in the form of two mutually parallel reinforcement bars.

In accordance with an additional feature of the invention, the corrugated panels have a given corrugation height, and the attaching means include a bolt for bolting the reinforcement bar to the wall structure and a spacer disposed between the reinforcement bar and the wall structure, the spacer having a length corresponding to the given corrugation height.

In accordance with a further feature of the invention, the hurricane shutter assembly includes means for attaching the reinforcement bar to the corrugated panels. Preferably, these means include a bolt a nut assembly, the bolt and nut assembly including a nut attached to at least one of the corrugated panels and a bolt for bolting the reinforcement bar by threading into the nut. It is advantageous, if the bolt is in the form of a thumbscrew, so as to facilitate manual assembly without the necessity for tools.

In accordance with again another feature of the invention, the nut is permanently attached to the corrugated panel, for instance by welding, gluing (epoxy gluing) or soldering. It is understood that it is an equivalent structure, if the bolt is permanently attached to the corrugated panel. In that case, after the panels have been put into place, the reinforcement bar is placed thereon and attached with thumb screws.

With the foregoing and other objects in view there is also provided, in accordance with the invention, a method of improving the resistive strength of a hurricane shutter assembly, which comprises: assembling a hurricane shutter assembly by inserting a plurality of panels into a U-rail at a header of an opening to be covered and attaching the panels to a sill below the opening to be covered; temporarily placing a reinforcement bar on the assembled plurality of panels and drilling openings through said panels corresponding to openings in said reinforcement bar; removing the reinforcement bar; disassembling the hurricane shutter assembly by removing the panels from the opening; and permanently attaching one member of a nut-and-bolt assembly to the panels in alignment with the openings drilled in the drilling step. At that point, the improved assembly may be securely stored, until it is needed in the event of an approaching hurricane or if the building is to be locked up for an extended period of time.

In accordance with a concomitant feature of the invention, the openings in the panels and in the reinforcement bar are drilled simultaneously in a single drilling step.

Other features which are considered as characteristic for the invention are set forth in the appended claims.

Although the invention is illustrated and described herein as embodied in a hurricane shutter reinforcement and method, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
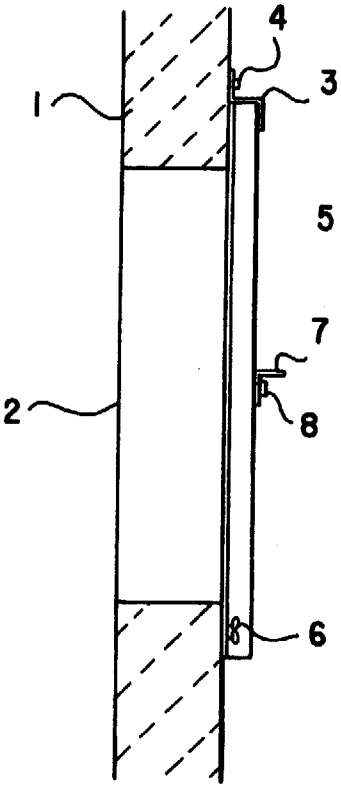
FIG. 1 is a cross-sectional view of the improved hurricane shutter assembly taken along the line I—I of FIG. 3.

Referring now to the figures of the drawing in detail and first, particularly, to FIG. 1 thereof, there is seen a wall 1 with a window opening 2. An upper U-rail 3 is attached to a header with bolts 4 just above the window 2. A corrugated panel 5 covers the window opening 2. The panel 5 is attached to the wall with bolts 6 just below the window 2, at a sill. In order to facilitate easy attachment, the bolts 6 are embodied as wing-nuts 6. A reinforcement bar or center bar 7, which extends across the entire window opening 2, is bolted to the panel 5. Bolts 8 provided for that purpose are preferably also provided with thumbscrews. The panels are thus prevented from bulging out and creating a gap between the center portion of the panels and the wall 1 next to the window 2.

Figure 2:
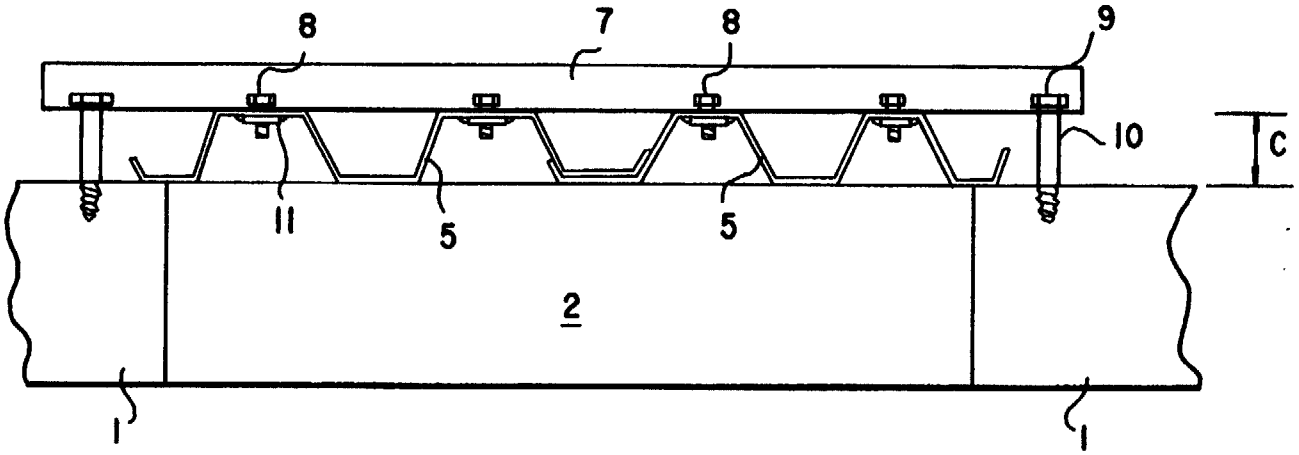
FIG. 2 is a cross-sectional view of the assembly taken along the line II—II of FIG. 3 and viewed in the direction of the arrows.

Referring now to FIG. 2, the center bar 7 is bolted to the wall 1 as well. Lateral bolts 9 with spacers 10 are provided for that purpose. The spacers 10 have a length which corresponds to a corrugation height C of the panel 5. The corrugation height C is defined as the perpendicular (i.e. shortest) distance of the highest peak of the corrugated panel from the surface upon which the panel is placed. Two panels 5 interlock in the center of the figure. It is understood that the panels are usually wider, with several more corrugations, i.e. peaks and troughs, each. In some instances it may even be preferable to interlock two corrugations between adjacent panels. The center bar 7 is shown as an L-bar. It may also be a U-rail, or the like. An important feature must be observed, namely that the center bar 7 cannot easily bend between the bolts 9.

As illustrated in FIG. 2, the panels 5 are bolted to the center bar 7 at each corrugation peak. This is not necessary in some applications, and it may suffice to attach the center bar 7 to panels at only one location. In fact, mere clamping of the panels with the reinforcement bar 7, i.e. without direct attachment thereof to the panels, will suffice in many applications. The thumbscrews or bolts 8 are threaded into nuts 11, which are permanently attached at the backside of the panels. Various possibilities are known to attach the nuts 11, for instance by welding, soldering, bolting, epoxy gluing, riveting, etc.

Figure 3:
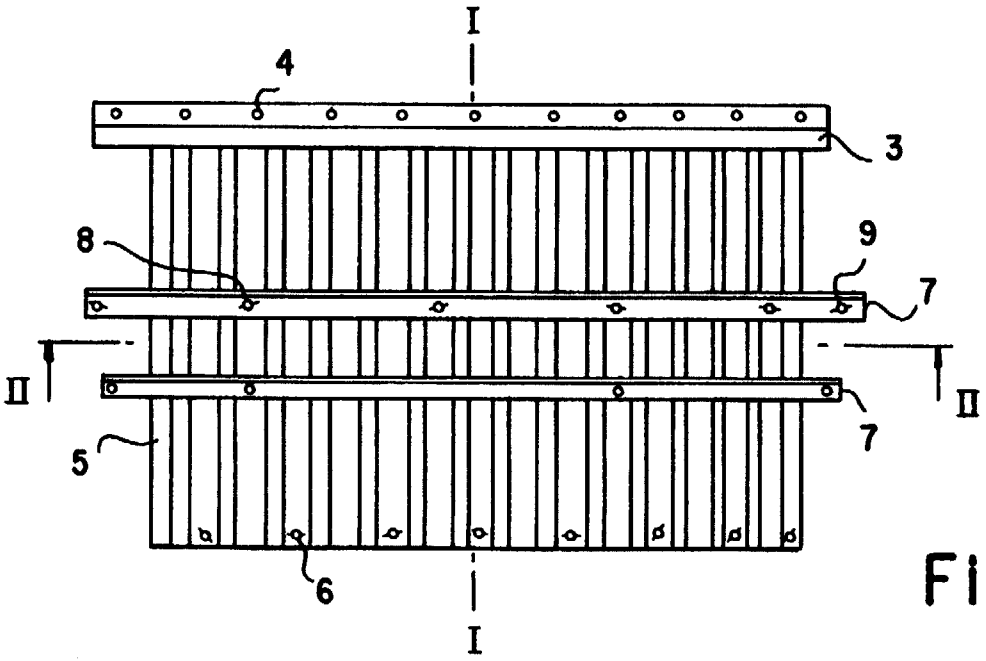
FIG. 3 is a front-elevational view of the hurricane shutter assembly.

Referring now to FIG. 3, the reinforcement bar 7 may be in the form of two center bars 7. This embodiment is feasible in the case of very long window or door openings. For example, in a hurricane shutter for a window of 5 feet length, a single reinforcement bar will normally suffice. In a window or door opening of 7 feet or more, two reinforcement bars as illustrated in FIG. 3 are recommended.

Figure 4:
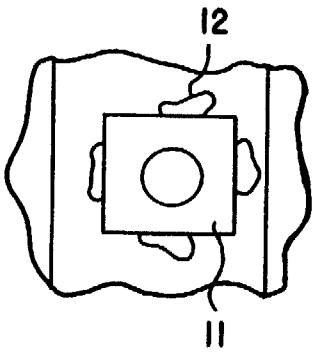
FIG. 4 is a partial top-plan view of a center bar attachment nut.

Referring now to FIG. 4, the nut 11 may be formed of stock aluminum. The material is approximately ¼" thick by 3" long and it is threaded in accordance with the required thread and bolt thickness. Fillet weld spots 12 (or solder 12) are shown around the nut 11.

Figure 5:
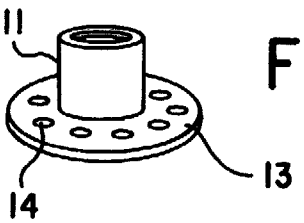
FIG. 5 is a perspective view of another attachment nut.

Referring now to FIG. 5, the nut 11 may alternatively be embodied as a threaded sleeve washer. The washer part 13 is provided with openings 14, which allow riveting, bolting, gluing or soldering to the panel 5.

Figure 6:
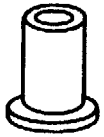
FIG. 6 shows a conventional pop rivet.

Referring now to FIG. 6, rivets are attached to the panels in a conventional manner. The pop-rivet shown in the figure may be riveted at an appropriate location on the panels while the panels are already in position at the window. The pop-rivets used in this context are internally threaded with a thread corresponding to the thumbscrew 8.

A method for reinforcing the corrugated hurricane shutters of the prior art is performed as follows:

First, a hurricane shutter is assembled in the conventional manner. In other words, several panels 5 are pushed from below or from the side into the U-rail 3 and bolted to the wall 1 with the bolts and nuts 6 until the window is fully covered. Next, the center bar 7 according to the invention is held against the shutter panels, preferably parallel to and centered between the U-rail 3 and a lower edge line of the panels 5. Holes are then drilled at the desired locations, directly through the center bar 7 and through the panels 5. It is also possible to only mark the location for the openings at this point and to drill the openings later. After all the openings have been prepared, the center bar is placed aside, the panels 5 are removed from the window and the nuts 11 are attached directly behind the openings which were just drilled.

After the nuts 11 are attached, the panels 5 are again assembled and the center bar 7 is bolted to the panels. Finally, holes are drilled into the wall for the lateral bolts 9 and, after anchors have been placed in the walls, the reinforced hurricane shutter is ready for final assembly in which the lateral bolts 9 (with the spacers 10) "tie" the system together.

At that point, the reinforced hurricane shutter assembly may be removed and stored in a safe place until it is needed for attachment to the house during a hurricane warning.

I claim:

1. An improved hurricane shutter assembly for protecting an opening of a building, of the type in which a plurality of corrugated panels are attached between a header above the opening and a sill below the opening, and in which the corrugated panels extend beyond lateral edges of the opening for covering substantially the entire opening, wherein the improvement comprises:

a reinforcement bar extending between the header and the sill of the opening to be covered, and means for attaching said reinforcement bar to a wall structure disposed laterally of the opening.

2. The hurricane shutter assembly according to claim 1, wherein said reinforcement bar is in the form of two mutually parallel reinforcement bars.

3. The hurricane shutter assembly according to claim 1, wherein the corrugated panels have a given corrugation height, and said attaching means include a bolt for bolting said reinforcement bar to the wall structure and a spacer disposed between said reinforcement bar and the wall structure, said spacer having a length corresponding to the given corrugation height.

4. The hurricane shutter assembly according to claim 1, including means for attaching said reinforcement bar to the corrugated panels.

5. The hurricane shutter assembly according to claim 4, wherein said means for attaching said reinforcement bar to the corrugated panels include a bolt-and-nut assembly, said bolt-and-nut assembly including a nut attached to at least one of the corrugated panels and a bolt for bolting said reinforcement bar by threading into said nut.

6. The hurricane shutter assembly according to claim 5, wherein said nut is permanently attached to the corrugated panel.

7. The hurricane shutter assembly according to claim 6, wherein said nut is attached by welding.

8. The hurricane shutter assembly according to claim 6, wherein said nut is attached by gluing.

9. The hurricane shutter assembly according to claim 8, wherein said nut is attached by expoxy gluing.

10. The hurricane shutter assembly according to claim 6, wherein said nut is attached by soldering.

11. The hurricane shutter assembly according to claim 1, wherein said reinforcement bar extends substantially parallel to and midway in between the header and the sill.

12. A method of improving the resistive strength of a hurricane shutter assembly, which comprises:

assembling a hurricane shutter assembly by inserting a plurality of panels into a U-rail at a header of an opening to be covered and attaching the panels to a sill below the opening to be covered;

temporarily placing a reinforcement bar on the assembled plurality of panels and drilling openings through said panels corresponding to openings in said reinforcement bar;

removing the reinforcement bar;

disassembling the hurricane shutter assembly by removing the panels from the opening; and permanently attaching one member of a nut-and-bolt assembly to the panels in alignment with the openings drilled in the drilling step.

13. The method according to claim 12, which comprises drilling the openings in the panels and in the reinforcement bar simultaneously in the drilling step.

* * * * *